US011756711B2

(12) United States Patent
Lynch

(10) Patent No.: US 11,756,711 B2
(45) Date of Patent: Sep. 12, 2023

(54) FUSE CUTOUT COVER WITH EXTENDABLE ROOF

(71) Applicant: Eco Electrical Systems, Reno, NV (US)

(72) Inventor: Michael Lynch, Reno, NV (US)

(73) Assignee: Eco Electrical Systems, Inc., Reno, NV (US)

( * ) Notice: Subject to any disclaimer, the term of this patent is extended or adjusted under 35 U.S.C. 154(b) by 406 days.

(21) Appl. No.: 17/192,352

(22) Filed: Mar. 4, 2021

(65) Prior Publication Data

US 2022/0285056 A1 Sep. 8, 2022

(51) Int. Cl.

| | |
|---|---|
| ***H01B 17/00*** | (2006.01) |
| ***H01B 17/56*** | (2006.01) |
| ***H01R 33/95*** | (2006.01) |
| *H01H 85/02* | (2006.01) |

(52) U.S. Cl.

CPC ..... *H01B 17/56* (2013.01); *H01R 33/95* (2013.01); *H01H 85/0241* (2013.01)

(58) Field of Classification Search

CPC ..... H01B 17/56; H01R 33/95; H01H 85/0241

See application file for complete search history.

(56) References Cited

U.S. PATENT DOCUMENTS

| | | | | |
|---|---|---|---|---|
| 2016/0247654 | A1* | 8/2016 | Onoda | H01H 85/0241 |
| 2017/0309377 | A1* | 10/2017 | Kumar | H01B 17/56 |
| 2017/0345601 | A1* | 11/2017 | Kitano | H01M 50/581 |

* cited by examiner

*Primary Examiner* — Pete T Lee

(74) *Attorney, Agent, or Firm* — Patent Law Group; Brian Ogonowsky

(57) ABSTRACT

In one embodiment, a fuse cutout cover has an integral roof portion. The roof portion covers the energized top of a fuse in a first type of cutout. An attachable roof extension covers the energized top of a fuse in a larger second type of cutout. By having the optional roof extension feature, the same cover may be used with two types of cutouts. The roof extension is connected using a cruxiform connector on the bottom surface of the roof portion that tightly fits into a hole in the roof extension. To prevent an air gap between the cruxiform connector and the hole in the roof extension, the bottom of the hole is sealed. This prevents flashovers through the air gap. As a result, electrical insulation between wildlife and the energized cutout is increased.

9 Claims, 6 Drawing Sheets

FUSE CUTOUT COVER WITH EXTENDABLE ROOF

FIELD OF THE INVENTION

The invention relates to a dielectric cover for a high voltage fuse cutout that protects birds and other animals from electrocution, which may also trigger an over-current condition that causes a power outage. The invention more particularly relates to a customizable cover that can cover a variety of types of fuse cutouts while ensuring protection for the wildlife.

BACKGROUND

FIGS. 1-3 illustrate a problem with the inventor's own previous design. The design is not prior art.

FIG. 1 is copied from the Applicant's U.S. patent application Ser. No. 16/591,039, incorporated herein by reference.

In FIG. 1, an incoming high voltage wire (not shown) attaches to a top connector in the fuse cutout 70. An outgoing wire attaches to a bottom connector 71, and may go to a transformer or other equipment.

The conventional fuse cutout 70 includes a fuse 73 that blows when a current exceeds a threshold. This causes the blown fuse to pivot downward to electrically disconnect the top of the fuse 73 from a high voltage connector 72. The fuse 73 can be manually disconnected using a hot stick or a load breaker tool by pulling down on the ring 74. The cutout 70 also includes an insulator 76, which is attached to a utility pole using a bracket 78.

To prevent birds and other wildlife from creating a flashover between a high voltage component and another wire or a grounded structure, a molded polymer cutout cover 140 is affixed over the cutout 70. Retaining pins 80 extend through holes in the cover 140 and under the high voltage connector 72 to prevent the cover 140 being blown off in high winds.

The cover 140 includes an integral molded roof 144 that is adequate to cover the tops of fuses in certain types of fuse cutouts. FIG. 1 also shows an optional roof extension 142 that attaches to the roof 144 in order to extend the roof outward to cover the particular type of "large" fuse cutout 70 shown in FIG. 1. The fuse cutout 70 in FIG. 1 is a Fault Tamer™ cutout 70. Accordingly, the same cover 140 may be used for large and small cutouts.

FIG. 2 is a bottom up view of where the roof extension 142 attaches to the roof 144. The roof 144 is molded with three male cruxiform connectors 145, one of which is shown in FIG. 3. The cruxiform connectors 145 tightly fit into molded holes 146 in the roof extension 142, when pressed together, to create a semi-permanent connection. The cruxiform connector 145 is basically a protruding plus sign or cross that fits tightly into the hole 146 when pressed together to connect two plastic pieces together.

During high voltage testing of the structure of FIG. 1, while salt water was being sprayed on the device of FIG. 1, it was found that a flashover occurred between the roof extension 142 and the roof 144. This was a weak link in the dielectric cover. After extensive analysis, Applicant concluded that the small air gap between the cruxiform connector 145 (on the roof 144) and the open hole 146 (in the roof extension 142) allowed the flashover to occur. The flashover path was via the air gap to a high voltage component closest to the holes 146. The cause of the flashover was not obvious to the Applicant or to the tester of the device.

What is needed is a low cost solution to the above flashover problem in a fuse cutout cover or other high voltage cover that employs a cruxiform-hole connector for connecting together dielectric parts.

SUMMARY

In one embodiment of the invention, a fuse cutout cover is provided that has a molded roof that is suitable for covering the top of a fuse in certain types of fuse cutouts. A separate roof extension is provided for covering larger types of fuse cutouts, such as a Fault Tamer™ cutout. The roof has molded male cruxiform connectors that tightly fit into aligned holes in the roof extension.

In order to prevent flashovers through the air gaps between the cruxiform connector and the side of the holes, the holes are sealed at the bottom. There is no extra cost to sealing the hole since the roof extension is a single molded piece. The roof and the roof extension surfaces are flush so there is no significant air gap between them.

By sealing the bottom of the holes, there is no air gap created with the connection, and flashover is prevented between the roof and the roof extension.

The invention may be applied to any high voltage cover that connects dielectric pieces together using a cruxiform connector.

BRIEF DESCRIPTION OF THE DRAWINGS

Elements in the various figures that are the same or equivalent are labelled with the same numeral.

DETAILED DESCRIPTION

The present invention prevents flashover via the connection between dielectric pieces in a high voltage cover by sealing the bottoms of any holes that receive a male connector. In one example, the male connector is a cruxiform, forming a polymer plus sign or a cross, and the hole has sides that form a tight fit when the cruxiform is pressed into the hole. Typically, the hole has an open bottom, which creates an air gap, forming a weak link in high voltage protection. Flashover occurs through this air gap. By sealing the bottom of the hole, there is no air gap, and no weak link, so the dielectric properties of the high voltage cover are improved.

Figure 2:
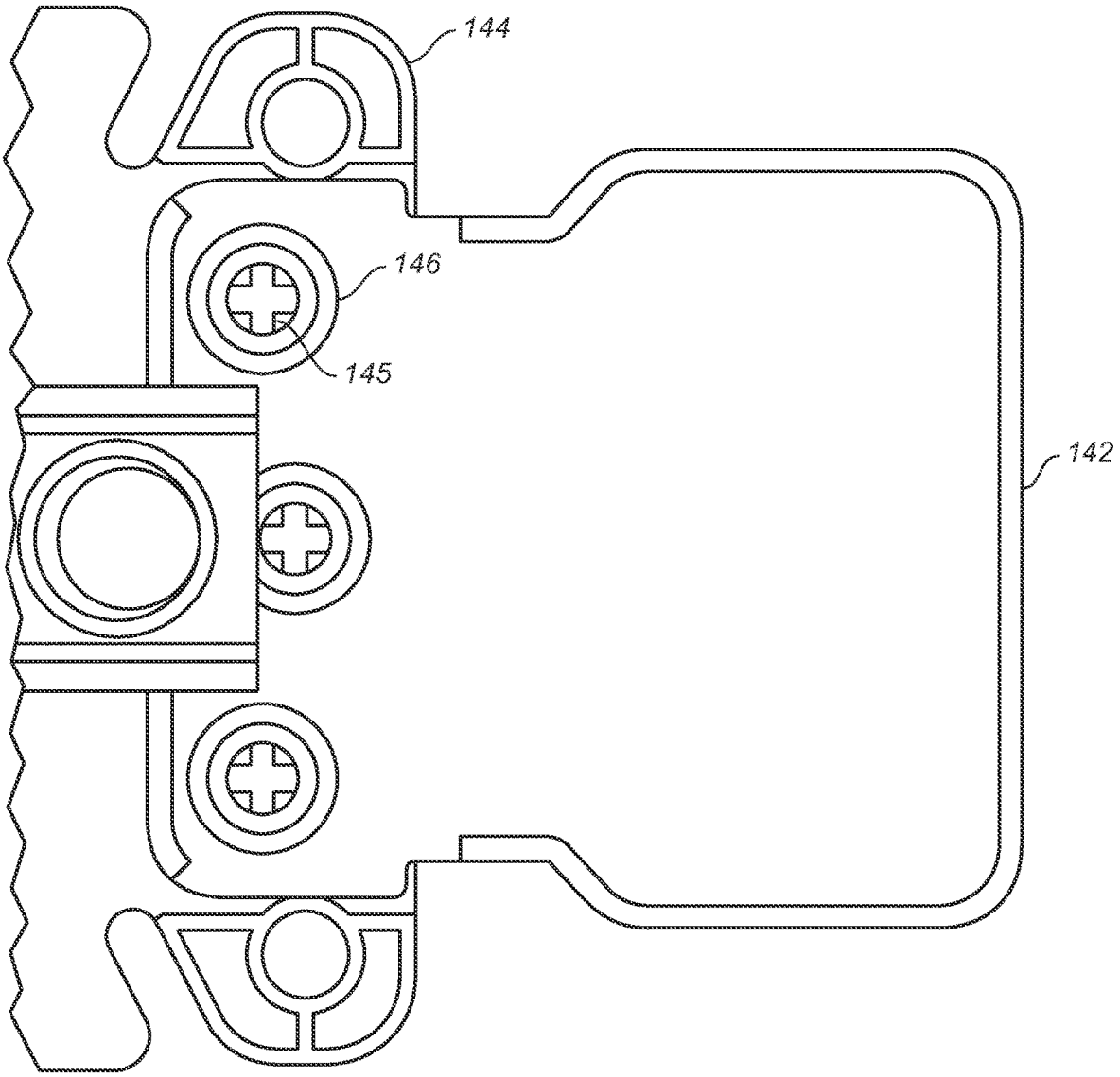
FIG. 2 is a bottom up view of the connection between the roof and the roof extension, showing the cruxiform connectors and the open holes.
Figure 3:
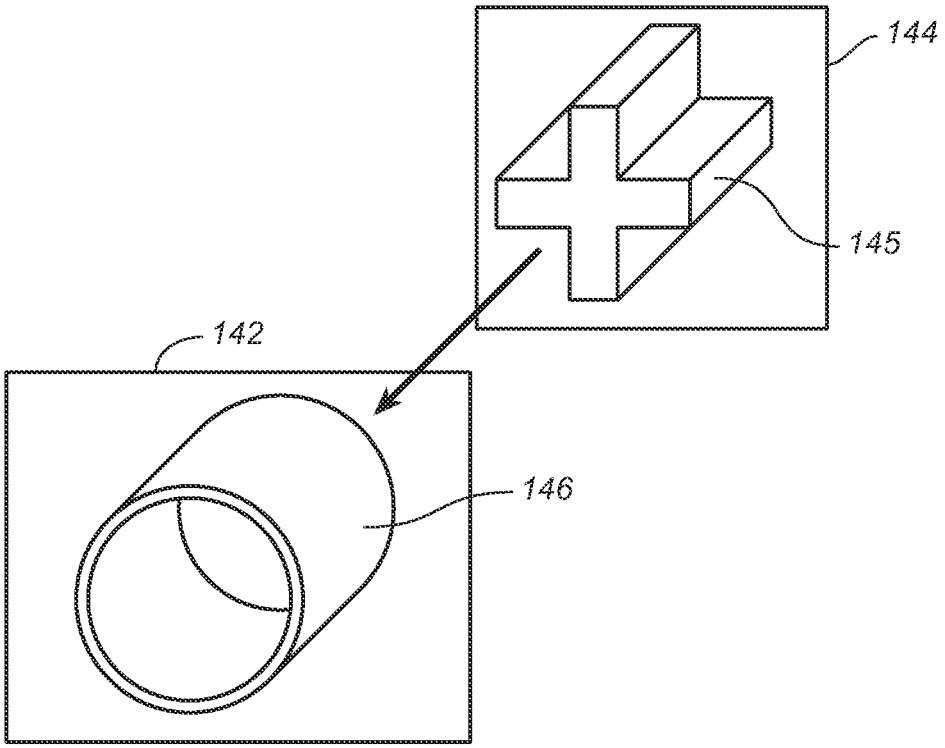
FIG. 3 is a perspective view of a single cruxiform connector on the roof and its aligned open hole in the roof extension.
Figure 4:
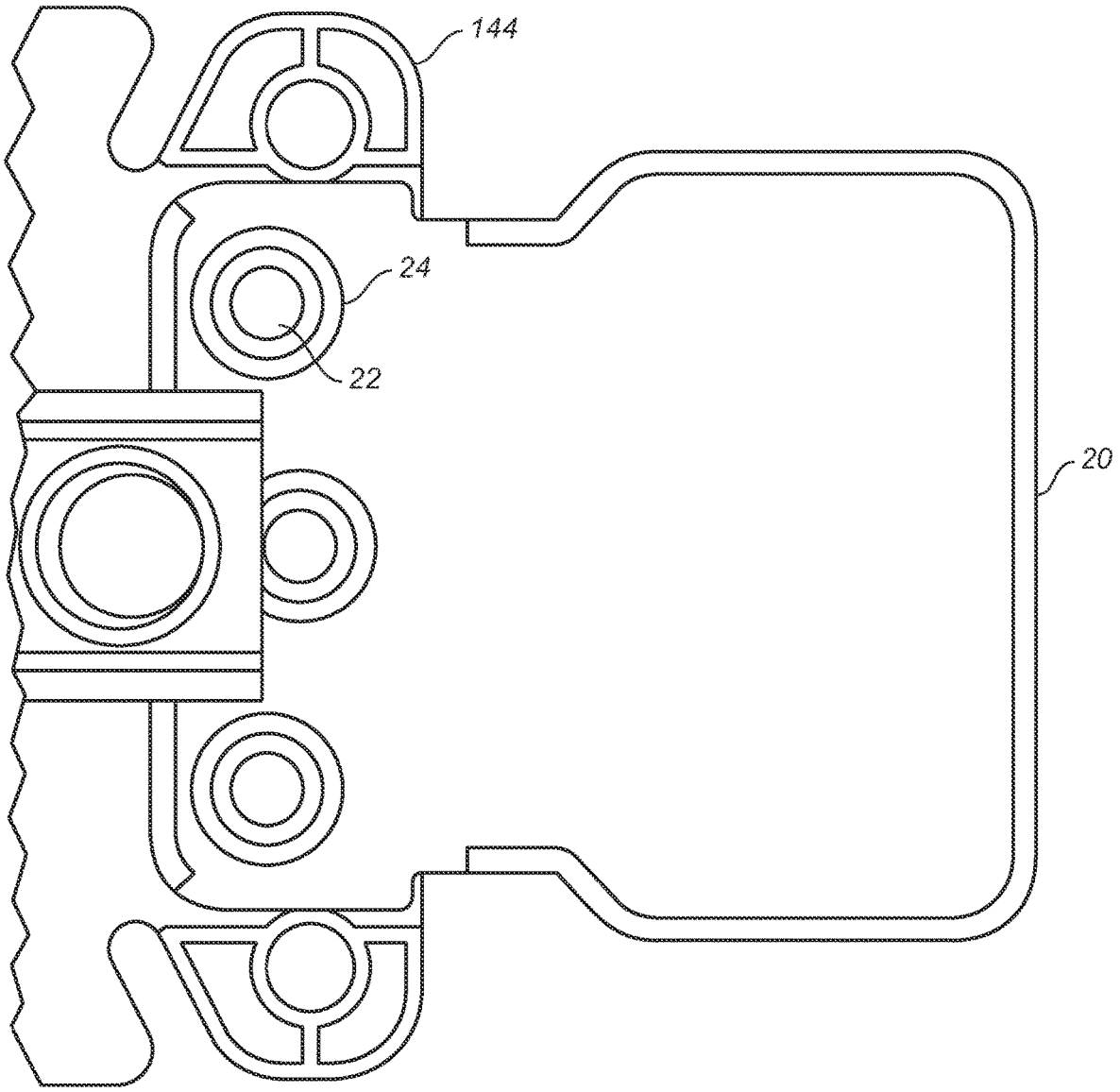
FIG. 4 is a bottom up view of the connection between the roof and the roof extension, in one embodiment of the invention, showing the closed holes.
Figure 5:
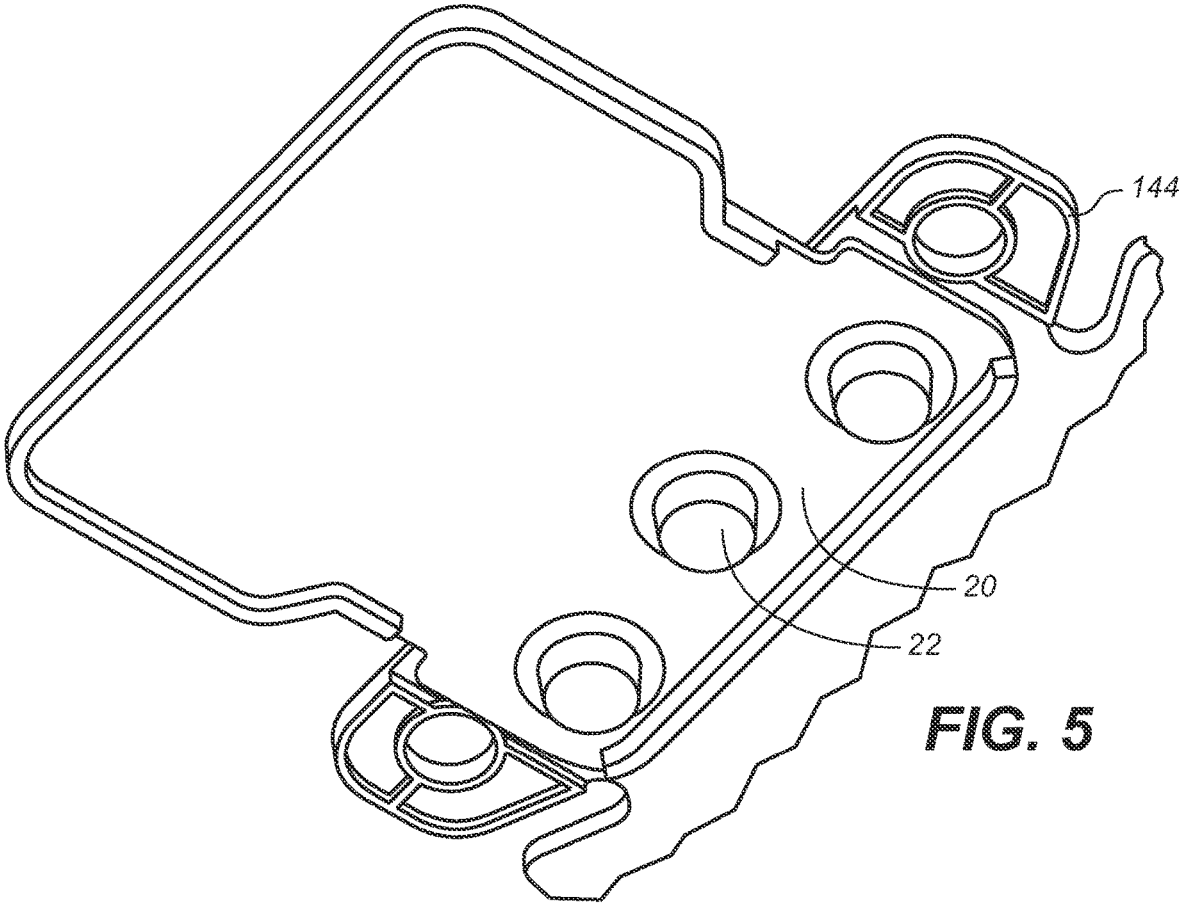
FIG. 5 is a bottom up perspective view of the connection between the roof and the roof extension, in one embodiment of the invention, showing the closed holes.
Figure 6:
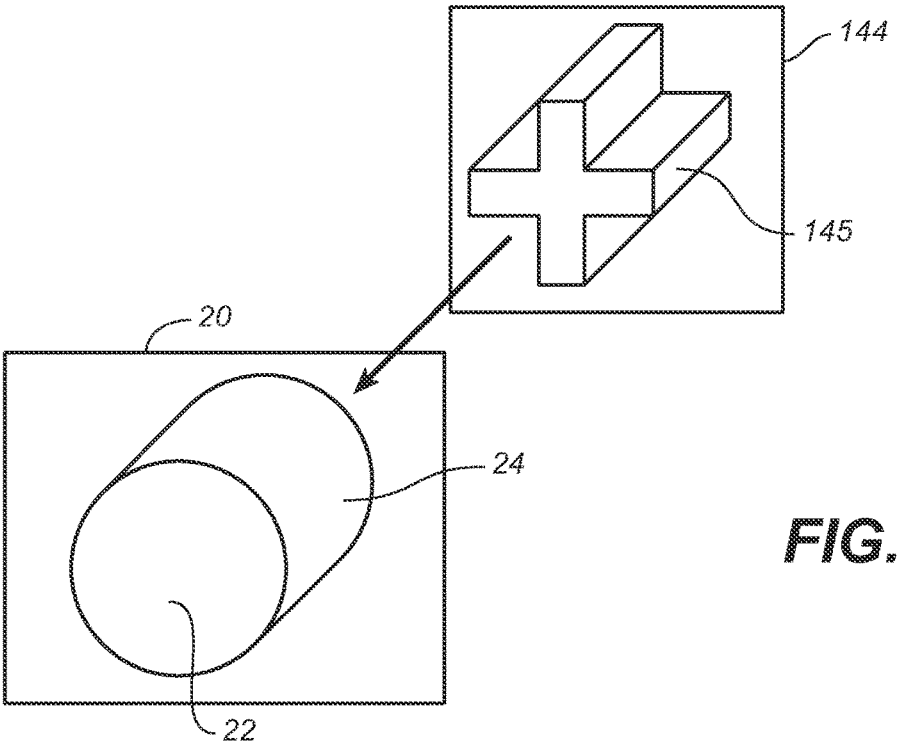
FIG. 6 is a perspective view of a single cruxiform connector on the roof and its aligned closed hole in the roof extension.

The example shown is a fuse cutout cover, and a modification of the Applicant's own design is shown in FIGS. 4-7. FIGS. 4-7 show the same cover 140 of FIGS. 1-3. However, the roof extension 20 is modified to close the bottom 22 of the hole 24 that receives the cruxiform connector 145. The roof extension 20 is otherwise identical to the roof extension 142 shown in FIGS. 1 and 2.

The sealing of the bottom 22 of the hole 24 prevents an air gap occurring in the connection between the cruxiform connector 145 and the hole 24 in the roof extension 142.

In one embodiment, the cruxiform connector 145 is about one-quarter to one inch in diameter (depending on the size of the cover) and protrudes about one-half inch from the bottom surface of the roof 144. The hole 24 in the roof extension has about the same diameter as the cruxiform connector 145 for a tight fit and protrudes downward from the bottom surface of the roof extension 20 by a depth so that the bottom surface of the roof 144 is flush with the top surface of the roof extension 20 so there is no or an insignificant air gap between the two pieces. The bottom of the cruxiform connector 145 may or may not contact the bottom 22 of the hole 24.

The modified roof extension 20 incurs no additional cost, yet its insulating properties are greatly enhanced.

Figure 1:
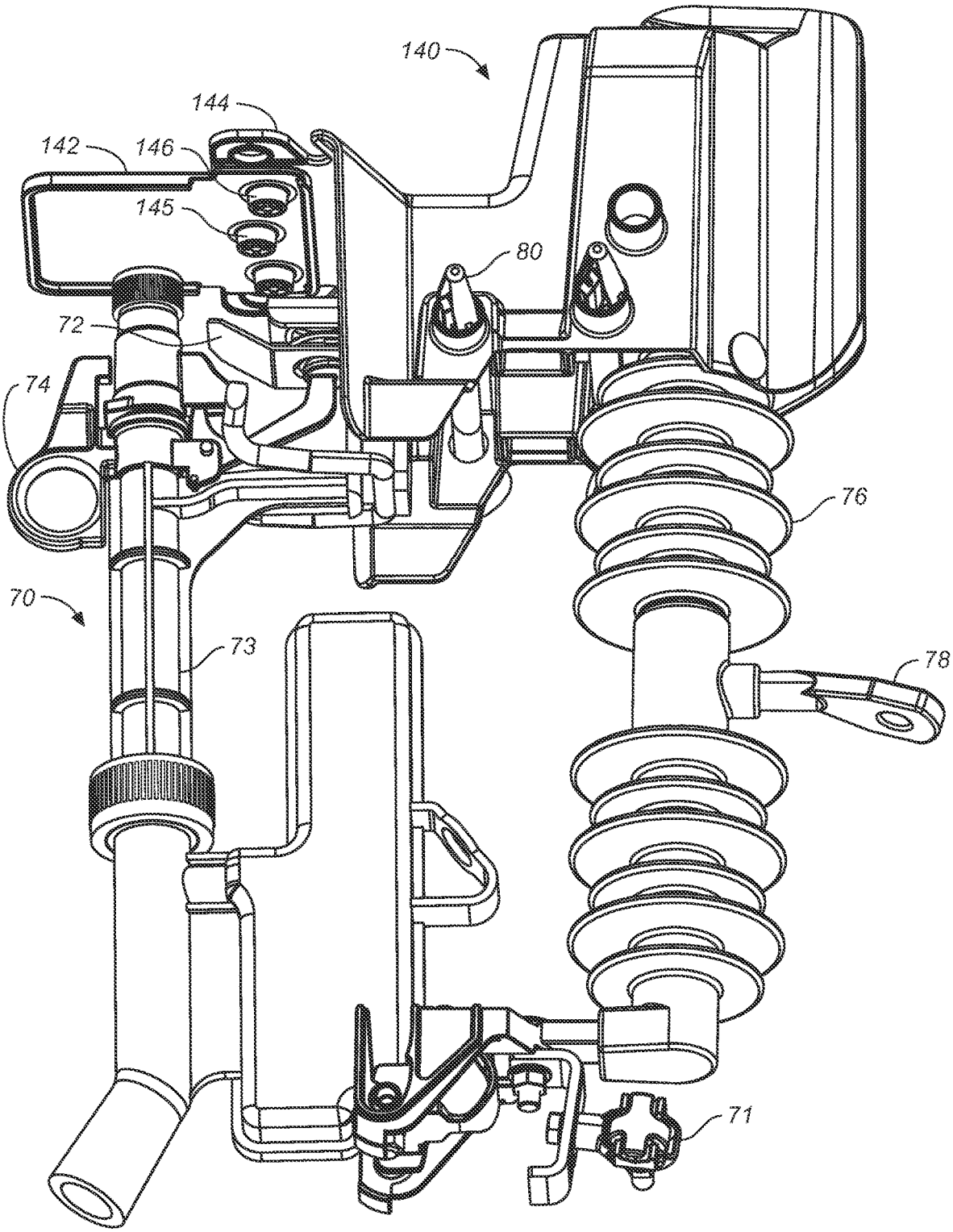
FIG. 1 is a bottom up perspective view of a conventional fuse cutout covered by a dielectric cover having a roof extension affixed to the cover using cruxiform connectors pushed through open holes in the roof extension.
Figure 7:
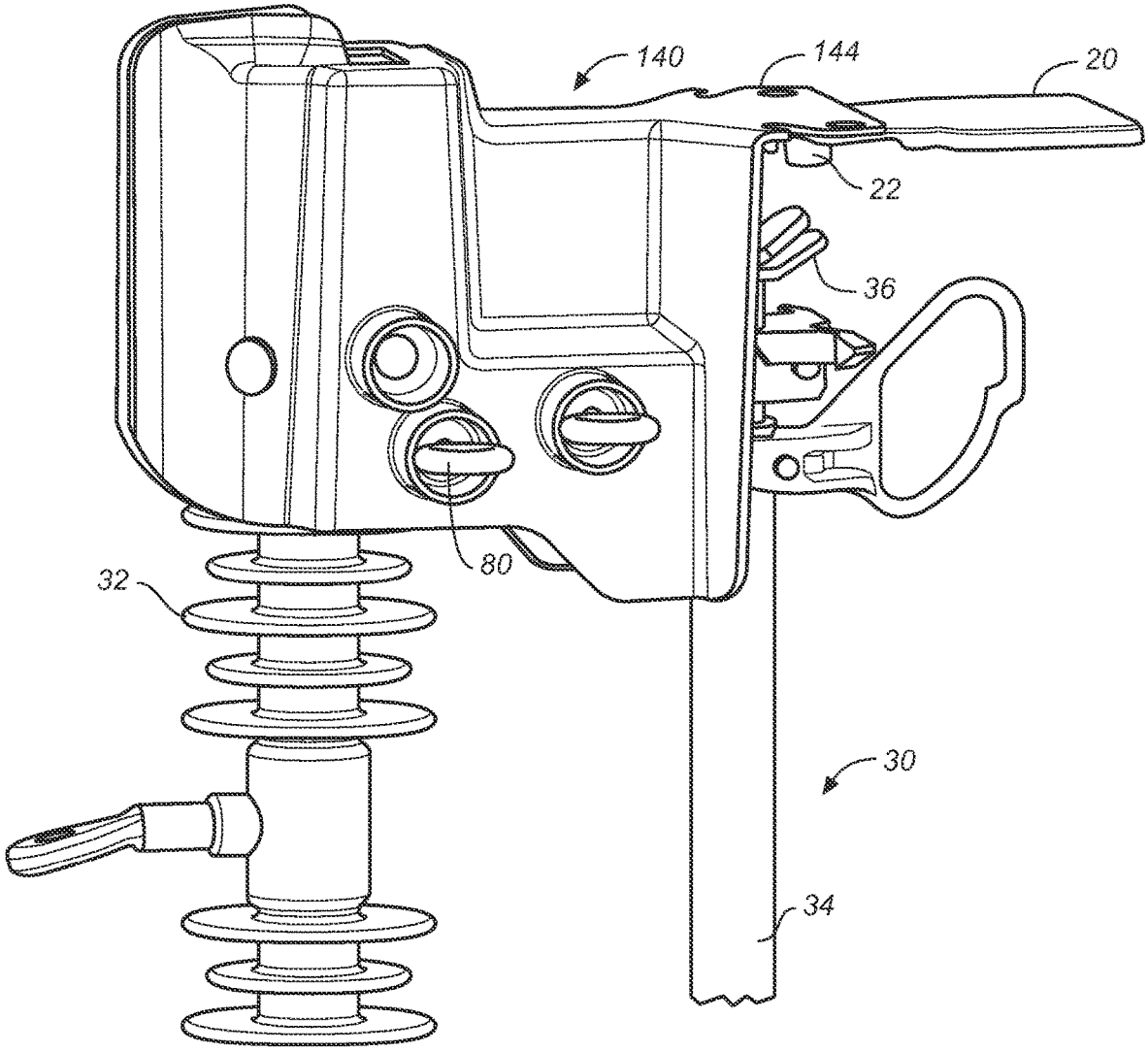
FIG. 7 is a side perspective view of a fuse cutout with a dielectric cover, in accordance with one embodiment of the invention, where the roof is connected to the roof extension using a male cruxiform connector through a hole in the roof extension, where the bottom of the hole is closed so there is no air path created due to the connection.

FIG. 7 shows the cover 140, connected to the roof extension 20, over a conventional fuse cutout 30 that is smaller than the cutout 70 in FIG. 1. The cutout 30 includes an insulator 32 and other conventional cutout components. In FIG. 7, the roof extension 20 is not needed to cover the top of the fuse 34 so is optional. The fuse 34 is supported by a pivot, such as shown in FIG. 1, having a bottom connector 71 (FIG. 1) for a wire. The fuse 34 connects to a top connector 36, electrically connected to a top wire (not shown), when the fuse 34 is in a closed position. When the fuse 34 blows or is pulled open by a lineman, the fuse 34 disconnects from the top connector 36 to open the circuit.

There may be multiple roofs for different types of fuse cutouts, and one or more of the roofs may have cruxiform connectors for attaching a roof extension.

Other types of covers, such as for high voltage insulators supporting an energized wire, may also have attachments that use a cruxiform connector and a hole. All such covers will benefit from sealing the bottom of the hole to prevent an air gap forming.

Other embodiments are envisioned.

Having described the invention in detail, those skilled in the art will appreciate that, given the present disclosure, modifications may be made to the invention without departing from the spirit of the inventive concept described herein. Therefore, it is not intended that the scope of the invention be limited to the specific embodiments illustrated and described.

What is claimed is:

1. A fuse cutout dielectric cover, the fuse cutout comprising an insulator, a first connector that provides electricity to a top end of a fuse, and a bottom connector that receives electricity from the bottom end of the fuse, the cover comprising:

a first portion configured for at least covering a top of the insulator;

a second portion extending from the first portion, the second portion having a roof portion configured for covering at least a portion of the first connector; the roof portion having at least one molded cruxiform connector; and an attachable roof extension for extending the roof portion, the roof extension having at least one hole for receiving the cruxiform connector, the at least one hole having a sealed bottom.

2. The cover of claim 1 wherein the cover is installed over the fuse cutout, the cover further comprising one or more pins that extend into openings in the cover and below the first connector to secure the cover in position.

3. The cover of claim 1 wherein the at least one cruxiform connector fits tightly against walls of the at least one hole.

4. The cover of claim 1 wherein the first portion and the second portion form a single molded piece.

5. The cover of claim 1 wherein the roof portion has at least three cruxiform connectors, and the roof extension has associated holes for attachment of the roof extension.

6. The cover of claim 1 wherein the roof extension is attached to the roof portion.

7. The cover of claim 1 further comprising pins configured for being inserted through openings in the cover for preventing the cover from being blown off the cutout.

8. The cover of claim 1 wherein the roof portion is substantially flat.

9. The cover of claim 1 wherein the cover is installed over the fuse cutout.

* * * * *